US006894233B2

(12) United States Patent
Dingwall et al.

(10) Patent No.: US 6,894,233 B2
(45) Date of Patent: May 17, 2005

(54) SYSTEMS AND METHODS FOR CLASSIFYING VEHICLES

(75) Inventors: Robert Dingwall, Stratford, NY (US); Paul Milnick, Accord, NY (US); John Emerick, Saugerties, NY (US); Gerald Jameison, Red Hook, NY (US)

(73) Assignee: The Revenue Markets, Inc., Accord, NY (US)

( * ) Notice: Subject to any disclaimer, the term of this patent is extended or adjusted under 35 U.S.C. 154(b) by 79 days.

(21) Appl. No.: 10/370,418

(22) Filed: Feb. 20, 2003

(65) Prior Publication Data

US 2004/0164749 A1 Aug. 26, 2004

(51) Int. Cl.[7] ..... G04G 9/00
(52) U.S. Cl. ..... 177/210 C
(58) Field of Search ..... 117/210 C

(56) References Cited

U.S. PATENT DOCUMENTS

| | | | | | |
|---|---|---|---|---|---|
| 3,565,195 | A | * | 2/1971 | Miller et al. | 177/210 R |
| 3,666,032 | A | | 5/1972 | Maffia et al. | 177/256 |
| 3,678,378 | A | * | 7/1972 | Trott et al. | 177/210 C |
| 3,748,443 | A | | 7/1973 | Kroll et al. | 235/92 TC |
| 3,835,945 | A | | 9/1974 | Yamanaka et al. | 177/134 |
| 3,875,481 | A | * | 4/1975 | Miller et al. | 361/283.1 |
| 4,013,851 | A | | 3/1977 | Abbondante | 200/86 R |
| 4,266,263 | A | * | 5/1981 | Haberl et al. | 361/283.2 |
| 4,366,876 | A | | 1/1983 | Chen | 177/210 C |
| 4,581,677 | A | * | 4/1986 | Hruby et al. | 361/283.1 |
| 4,793,429 | A | * | 12/1988 | Bratton et al. | 177/210 C |
| 5,002,141 | A | | 3/1991 | Loshbough et al. | 177/210 FP |
| 5,133,421 | A | | 7/1992 | Wang | 177/256 |
| 5,260,520 | A | | 11/1993 | Muhs et al. | 177/210 R |
| 5,597,984 | A | * | 1/1997 | Mohaupt | 177/210 C |
| 5,606,516 | A | | 2/1997 | Douglas et al. | 364/571.04 |
| 5,995,259 | A | | 11/1999 | Meli et al. | 359/134 |
| 5,998,741 | A | | 12/1999 | Beshears et al. | 177/133 |
| 6,112,600 | A | | 9/2000 | Sonderegger | 73/841 |
| 6,176,127 | B1 | | 1/2001 | Kim | 73/146 |
| 6,198,987 | B1 | | 3/2001 | Park et al. | 701/1 |
| 6,396,418 | B2 | | 5/2002 | Naito | 340/928 |

FOREIGN PATENT DOCUMENTS

| | | | |
|---|---|---|---|
| JP | 355119019 A | 9/1980 | 177/208 |

* cited by examiner

*Primary Examiner*—Randy W. Gibson
(74) *Attorney, Agent, or Firm*—Heslin Rothenberg Farley & Mesiti P.C.; Victor A. Cardona, Esq.

(57) ABSTRACT

A system for use in classifying a vehicle includes a capacitive sensor for operatively receiving a weight of a vehicle and a capacitance detector coupled to said capacitive sensor. The capacitance detector is adapted to determine a capacitance signal of the capacitive sensor in response to the capacitive sensor operatively receiving the weight of the vehicle.

51 Claims, 8 Drawing Sheets

PRIOR ART

Front Axle Single Tire

Rear Axle Dual Tire

SYSTEMS AND METHODS FOR CLASSIFYING VEHICLES

TECHNICAL FIELD

This invention relates, in general, to toll collections for vehicles and, in particular, to systems and methods for use in classifying vehicles for toll collection purposes.

BACKGROUND ART

Tolls charged for the use of automobile toll highways may vary according to certain factors, such as vehicle weight and a number of axles per vehicle, for example. Because tolls vary based on such factors, it is necessary to obtain information about vehicles as they pass through toll plazas to ensure that proper fares are charged.

Currently, a number of axles of vehicles moving through toll plazas may be determined through one or more sets of electrical contact switches located in one or more treadles located in the path of oncoming traffic as they pass through these plazas. Such treadles are typically arranged such that their longitudinal dimensions are substantially orthogonal to a direction of traffic. Also, treadles may be located in a cavity of a roadbed such that an upper surface of the treadle is substantially level with a surface of the roadbed. Alternatively, the treadles may be located on a surface of the roadbed with their top surfaces being slightly elevated from the surface of the roadbed. The electrical contact switches in the treadle are activated by a weight of a vehicle as it passes over the treadle. As depicted in FIGS. 1–3, a contact switch system 5 includes a first conductive strip 10 and a second conductive strip 20 separated by a space 30 and held in a rubber jacket 40 of a treadle 41 to maintain such a space or air gap between the conductive strips. As a vehicle passes over rubber jacket 40, first conductive strip 10 descends due to the weight of the vehicle and abuts second conductive strip 30. Each electrical contact of the conductive strips may be counted to allow a determination of a number of axles which cross the treadle in a certain period of time. Such electrical contact switches may thus allow the classification of vehicles based on the number of axles passing over such treadles.

Other examples of mechanisms for classifying vehicles include optical recognition devices, vehicle separation sensors, scales for weighing vehicles, and speed detection devices. The need for such devices has increased due to the advent of automatic RF (Radio Frequency) Electronic Toll Collection systems (e.g., EZ PASS, FASTLANE) which collect tolls electronically from a user's account without the necessity of the vehicle stopping at the toll plaza. However, some of these mechanisms require extensive renovations and/or road construction at such toll plazas for their installation.

Thus, a need exists for a system for determining a classification of a moving vehicle at toll collection plazas which utilizes existing assets of such plazas and does not require extensive renovations of the plazas.

SUMMARY OF THE INVENTION

The present invention provides, in a first aspect, a system for use in classifying a vehicle which includes a capacitive sensor for operatively receiving a weight of the vehicle. A capacitance detector is coupled to the capacitive sensor with such capacitance detector being adapted to determine a capacitance signal of the capacitive sensor in response to the first conductive strip receiving the weight.

The present invention provides, in a second aspect, a method for use in classifying a vehicle which includes receiving the vehicle on a surface of a capacitive sensor and determining a capacitance signal in response to the vehicle being received on the surface of the capacitive sensor.

The present invention provides, in a third aspect, a system in use for classifying a vehicle which includes a treadle having a first cavity and a second cavity. A first conductive strip and a second conductive strip are located in the first cavity and insulated from each other. Also, the first conductive strip and the second conductive strip are coupled to a capacitance detector. Further included is a third conductive strip and a fourth conductive strip located in the second cavity. The capacitance detector may determine a weight of the vehicle and/or a tire width of the vehicle in response to the vehicle passing over the first conductive strip.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be apparent from the following detailed description of preferred embodiments taken in conjunction with the accompanying drawings in which:

DETAILED DESCRIPTION

In accordance with the principles of the present invention, systems and methods for vehicle classification are provided.

Figure 4:
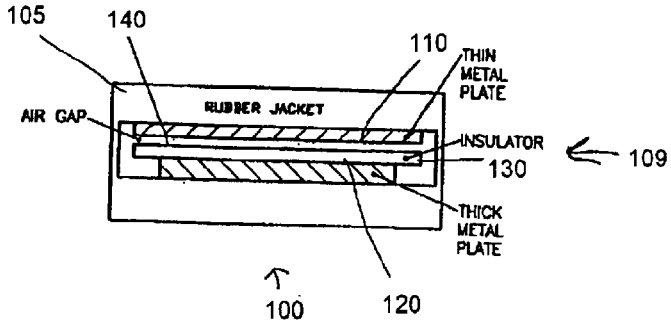
FIG. 4 is an end cross sectional view of a system for use in classifying a vehicle, in accordance with the present invention.
Figure 5:
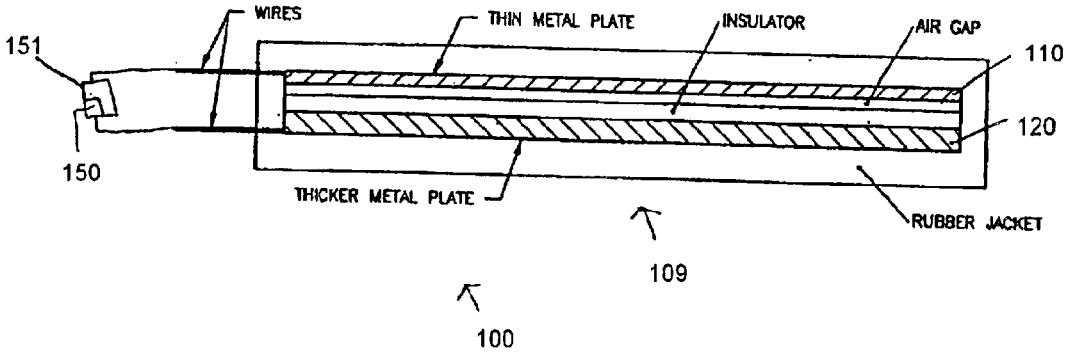
FIG. 5 is a front cross sectional view of the system of FIG. 4.
Figure 6:
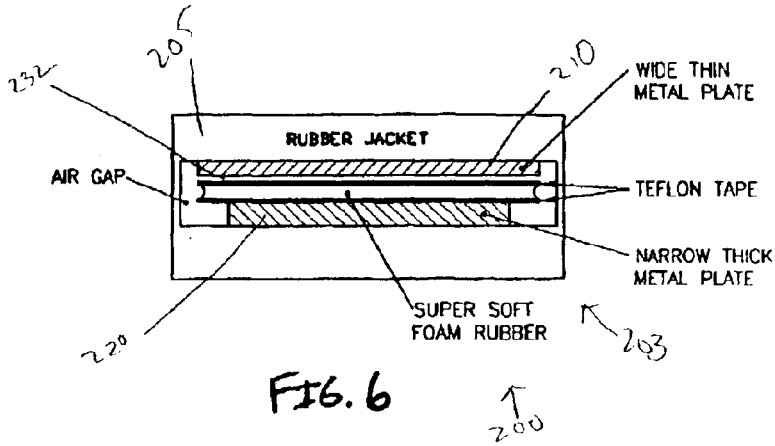
FIG. 6 is an end cross sectional view of another embodiment of a system for use in classifying a vehicle in accordance with the present invention.

In an exemplary embodiment depicted in FIGS. 4–5, a system 100 for classifying a vehicle is provided which includes a capacitive sensor 109 and a capacitance detector 150. Capacitive sensor 109 is mounted in a rubber jacket 105 of a treadle (not shown) dimensioned to be located in a cavity (not shown) of a roadbed (not shown). Capacitive sensor 109 includes a first conductive strip 110 separated from a second conductive strip 120 by an electrical insulator 130 or dielectric. There also may be a space or air gap 140 between insulator 130 and first conductive strip 110. First conductive strip 110 and second conductive strip 120 may be electrically coupled to capacitance detector 150.

Capacitance detector 150 may be adapted to detect a capacitance between first conductive strip 110 and second conductive strip 120. In one example, capacitance detector 150 may detect a change in capacitance due to a vehicle passing over rubber jacket 105 which may be received in a treadle (not shown). Specifically, as first conductive strip 110 is deformed and a portion thereof deflects toward second conductive strip 120, there is a relative capacitance increase due to the change in distance there between. This change in capacitance may be utilized to determine a number of axles which pass over the treadle and thus enable classification of vehicles based on their number of axles. Specifically, as each axle passes over the treadle, first conductive strip 110 is deflected downwardly thereby changing the capacitance and allowing capacitance detector 150 to determine the passing of each axle. Capacitance detector 150 may be analog or digital in nature and could include a variety of electrical or electronic circuits. Some examples of such circuits include a capacitor bridge, oscillating tank circuit, or a stable oscillating circuit utilizing an industry standard 555 timer integrated circuit. The output of such circuits may be processed digitally or using analog techniques.

In another embodiment, a system 200 for detecting a tire width to classify vehicles is depicted in FIGS. 6–9. A capacitive sensor 203 includes a first conductive strip 210 and a second conductive strip 220. First conductive strip 210 may be separated from second conductive strip 220 by an insulator 230 and/or a space 232 or cavity with the conductive strips being located in a rubber jacket 205 which may be received in a treadle (not shown). One example of such an insulator is super soft silicone foam rubber. Other examples of acceptable insulators include foam rubber, rubber, DELRIN, TEFLON, NYLON, and various other plastic materials. Preferably, any such material should be an insulator and have a firmness rating of 2 to 3, as is known by those skilled in the art. Such material is also desirably wear resistant and elastic. Also, first conductive strip 210 and second conductive strip 220 may be coupled to a capacitance detector 250.

Figure 8:
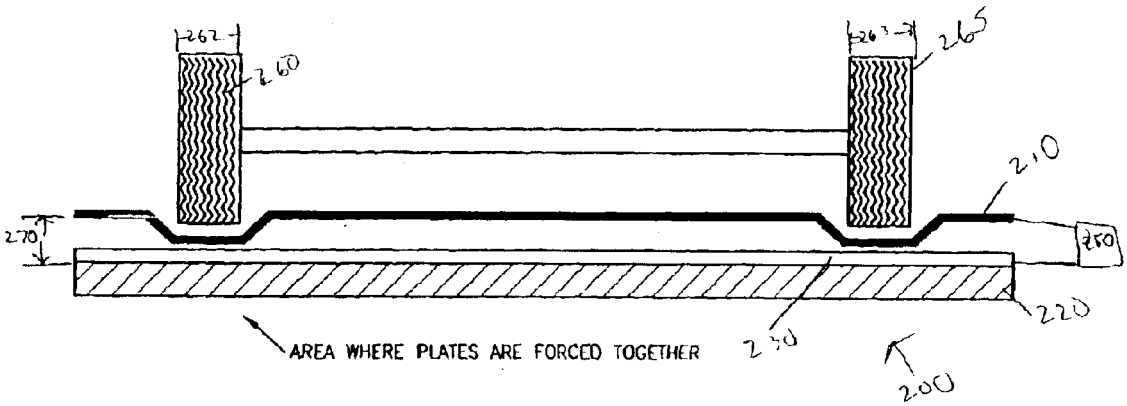
FIG. 8 is a front cross sectional view of a portion of the system of FIG. 6 shown receiving an axle of a vehicle and without the rubber jacket.
Figure 9:
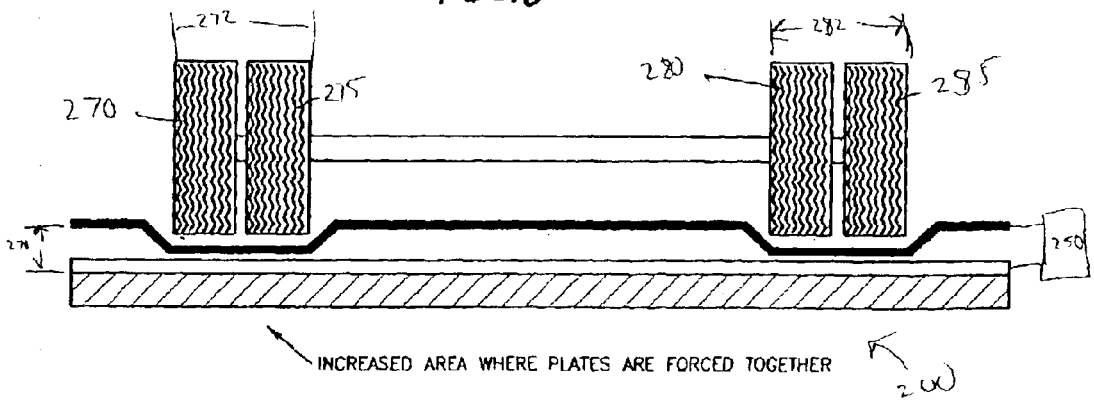
FIG. 9 is a front cross sectional view of a portion of the system of FIG. 6 shown receiving an axle having dual tires and without the rubber jacket.

First conductive strip 210 may be flexible to allow a portion thereof to be deformed under a weight of a tire 260 of the vehicle (not shown) as tire 260 applies weight to the treadle and thus the rubber jacket 205 above first conductive strip 210. Specifically, first conductive strip may abut insulator 230 which abuts second conductive strip 220 under an area of the applied weight, as depicted in FIG. 8. For example, first conductive strip 210 may be formed of a foil or a thin stainless steel plate. Second conductive strip 220 may be substantially rigid, i.e. formed of a thicker metal than first conductive strip of 210 or formed of a stiffened metal. Capacitance detector 250 may detect a change in capacitance relative to a static condition (i.e., no weight being applied) based on such deformation of first conductive strip 210. Based on the capacitance signal detected, capacitance detector 250 may provide an indication of such capacitance signal or a change therein. Alternatively, capacitance detector may determine a width of one or more tires based on such capacitance signal. Such a determination is possible due to the change in capacitance resulting from the weight operatively placed on first conductive strip 210 via rubber jacket 205 and a known distance 270 between first conductive strip 210 and second conductive strip 220 prior to the application of the weight. Using the following formula, a tire width, or an approximation thereof, may be determined, as will be understood by those skilled in the art:

$$C \approx \frac{KS}{d}$$

C=capacitance (farads)

K=constant (dielectric constant based on insulating material)

S=electrode plate size (area) (square meters ($M^2$))

d=distance between two electrode plates (meters)

For example, capacitance detector 250 may detect a first comparison width (e.g., for 2 single tires) which comprises a combination of a first width 262 of first tire 260 and a second width 263 of a second tire 265 when tire 260 and second tire 265 are operatively received on first conductive strip 210 via rubber jacket 205, as depicted in FIG. 8. Also, capacitance detector 250 may determine a second comparison width (e.g., for 2 sets of double tires) comprising a combination of a third width 272 and a fourth width 282. Third width 272 includes widths of a third tire 270 and a fourth tire 275 while fourth width 282 includes widths of a fifth tire 280 and a sixth tire 285, all of which may pass over rubber jacket 205 (e.g., via a treadle receiving rubber jacket 205) and thus first conductive strip 210 simultaneously. The ability to determine the difference between separate comparison widths (e.g., between the first comparison width and second comparison width) enables separate classifications (e.g., single tire or double tire) to be determined. Thus, different fares may be charged to vehicles having a different number of tires per axle. Referring to the above formula, at the locations of the applied weight (i.e., under the tires) the top conductive strip (i.e., first conductive strip 210) operatively abuts a bottom conductive strip (i.e., second conductive strip 220). This deflection causes less of the conductive strips to be spaced apart from each other, relative to a static condition, thereby resulting in a portion of the electrode plate area having a diminished distance (i.e., "d") between electrode plates and thus an increase in capacitance which may be detected by capacitance detector 250. The length dimension (i.e., in the direction of motion) of the tires is assumed to be constant thus allowing the area measurement (i.e., "S") to provide an indication of tire width. For example, as the tire width increases, a portion of the top strip deflected to abut the bottom conductive strip, as compared to a static condition, increases thereby resulting in an increase in total capacitance and an indication of increased tire width by capacitance detector 250.

Also, first conductive strip 210 may be wider than second conductive strip 220 in a direction substantially orthogonal to a longitudinal direction of the strips. This difference in widths allows the area in which the strips are compressed to remain constant throughout the sliding action which occurs as first conductive strip and second conductive strip 220 operatively abut one another via insulator 230 and allows the strips to remain substantially vertically aligned while the vehicle passes over the treadle. Specifically, an entirety of second conductive strip 220 is always in operative contact (i.e., via insulator 230) with first conductive strip 210 as it moves due to the motion of the vehicle, because second conductive strip 220 is narrower in a direction of vehicle traffic than first conductive strip 210 which moves due to the motion of the vehicle passing over rubber jacket 205. Thus, the strips remain vertically aligned because, although first conductive strip 210 moves, it does not move in a direction of the vehicle traffic beyond the width of second conductive strip 220. In another example, second conductive strip 220 may be wider than first conductive strip 210 such that they remain in operative contact as described above.

Figure 7:
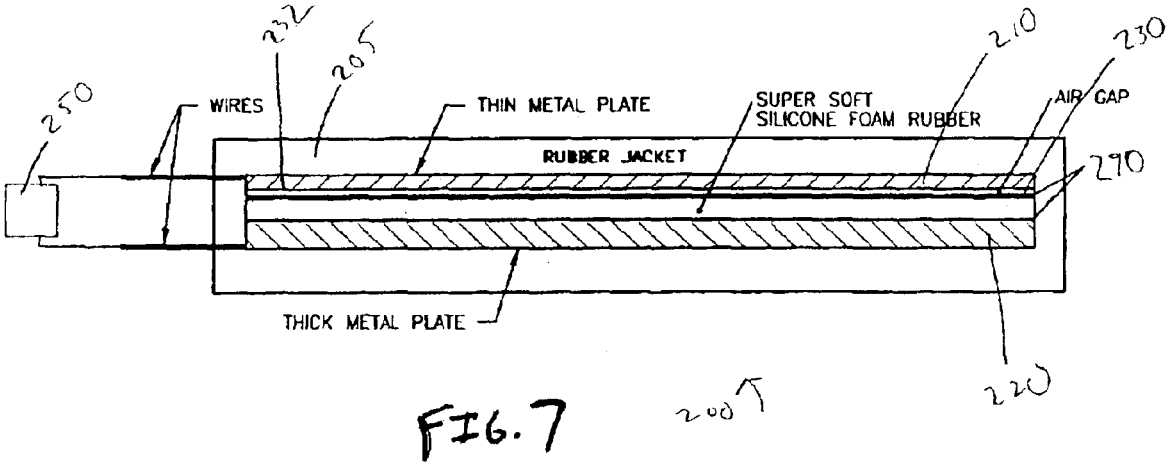
FIG. 7 is a front cross sectional view of the system of FIG. 6.

A wear resistant material 290, e.g., TEFLON tape, may be provided between insulator 230 and first conductive strip 210 and second conductive strip 220 to protect the conductive strips and insulator 230 from wear during operation, as depicted in FIG. 7. Specifically, as first conductive strip continuously deforms or deflects and is moved against insulator 230, which wipes against second conductive strip 220 due to the motion of vehicles passing over rubber jacket 205, wear resistant material 290 inhibits conductive strip 210 from wearing through insulator 230. Thus, wear resistant material 290 may inhibit an electrical connection between conductive strip 21 0 and second conductive strip 220 due to deterioration of insulator 230 which could thereby render system 200 inoperable. Insulator 230 may also be elastic or resilient such that it causes first conductive strip 210 to elastically return upon removal of the weight (e.g., a tire of a vehicle) placed on jacket 205 (e.g., via a treadle which receives rubber jacket 205). Further, insulator 230 must be compressible enough to allow first conductive strip 210 to deflect toward second conductive strip 220 such that first conductive strip 210 abuts insulator 230 and insulator 230 abuts second conductive strip 220. One example of such an insulator is super soft silicone foam rubber and others include those described above for insulator 230. Further, it will be understood to those skilled in the art that wear resistant material 290 may also be an electrical insulator.

As will be understood by those skilled in the art, system 200 may be modified to change a size of the area of each conductive strip or to change the type of insulation. Further, additional conductive strips could be added to increase the overall capacitance thereby increasing an amplitude of the capacitance signal, as will be understood by those skilled in the art.

Figure 10:
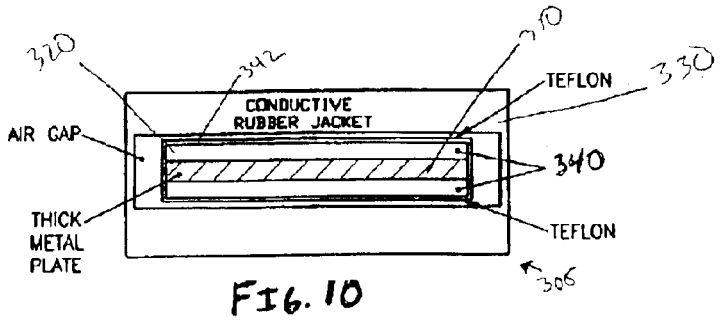
FIG. 10 is an end cross sectional view of a system for use in classifying a vehicle having one conductive strip in an interior portion of a rubber jacket in accordance with the present invention.
Figure 11:
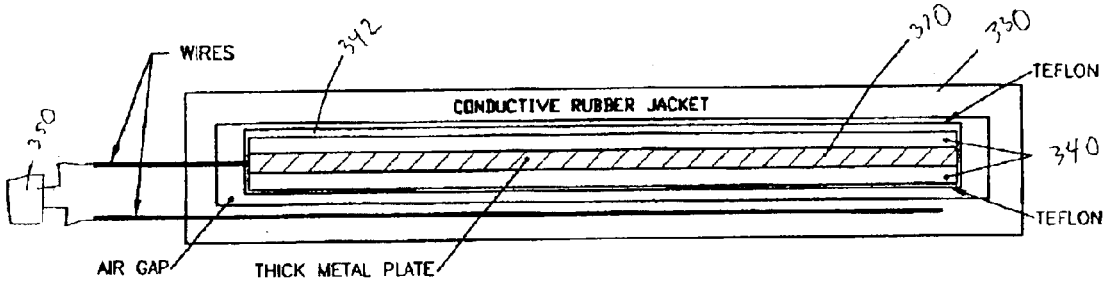
FIG. 11 is a front cross sectional view of the system of FIG. 10.

Another example of a system 300 for detecting a tire width to classify vehicles is depicted in FIGS. 10–11. A capacitive sensor 305 includes a conductive strip 310 located in a cavity 320 of an electrically conductive rubber jacket 330 of a treadle (not shown). A capacitance detector 350 is coupled to conductive strip 310 and conductive rubber jacket 330 via electrical conductor(s), e.g. standard electrical wires. Insulators 340 and possibly a space 342 may be located between conductive strip 310 and conductive rubber jacket 330. As a vehicle (not shown) passes over conductive rubber jacket 330, received in a treadle (not shown) located in a roadbed (not shown), for example, a portion of conductive rubber jacket 330 beneath the weight is deflected toward conductive strip 310. The deflection of jacket 330 toward conductive strip 310, which is substantially rigid, causes a change in capacitance between jacket 330 and conductive strip 310. Specifically, a portion of rubber jacket 330 directly under the weight (e.g., tire(s) of the vehicle) abuts one of insulators 340 which abuts conductive strip 310 thereby allowing capacitance detector 350 to determine a width of the tires passing over the treadle, as described above for capacitance detector 250.

Figure 12:
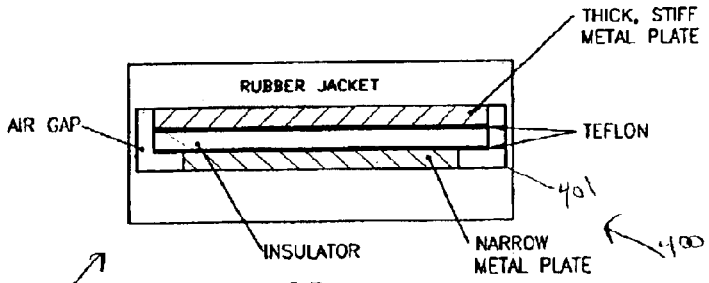
FIG. 12 is an end cross sectional view of another embodiment of a system for use in classifying a vehicle.
Figure 13:
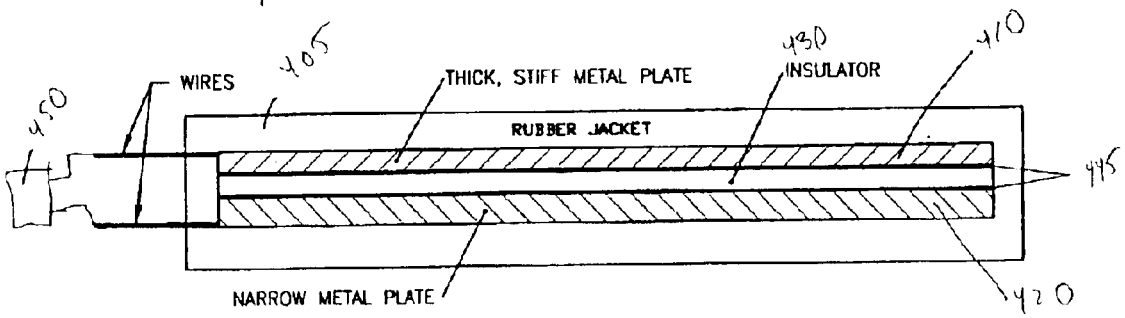
FIG. 13 is a front cross sectional view of the system of FIG. 12.

In another example, a system 400 for classifying a vehicle according to weight is provided, as depicted in FIGS. 12–13. A capacitive sensor 403 includes a first conductive strip 410 separated from a second conductive strip 420. These conductive strips are located in a cavity 401 of a rubber jacket 405 of a treadle (not shown) and are coupled to a capacitance detector 450. An insulator 430 (e.g., medium density silicone foam rubber) and/or a space (not shown) may be located between first conductive strip 410 and second conductive strip 420. A wear resistant strip 445 (e.g., TEFLON tape) may be located between insulator 440 and first conductive strip 410 and/or second conductive strip 420. First conductive strip 410 may be a thick, substantially stiff or rigid metal plate. Also, first conductive strip 410 may be wider than second conductive strip 420, or vice versa, to maintain the strips in vertical alignment, as discussed above with reference to first conductive strip 210 and second conductive strip 220.

Rubber jacket 405 may be located in a treadle (not shown) in a cavity (not shown) of a roadbed (not shown) and may receive a weight of one or more tires of a vehicle (not shown) passing through a toll plaza. Because first conductive strip 410 is substantially rigid, it does not deflect such that it operatively abuts second conductive strip 420, but instead first conductive strip 410 deflects toward second conductive strip 420 to cause a change in a capacitance signal determined by capacitance detector 450 while maintaining a separation between first conductive strip 410 and second conductive strip 420. The weight of the vehicle (not shown) may be determined by capacitance detector 450 due to a change in the capacitance signal received by capacitance detector 450 resulting from a change in distance between first conductive strip 410 and second conductive strip 420 caused by the weight. The thickness of first conductive strip 410 allows the weight of an axle passing over first conductive strip 410 to be distributed over the length of first conductive strip 410. Specifically, the increased thickness of first conductive strip 410 as compared to first conductive strip 210 allows first conductive strip 410 to be deflected over a longer length thereof as compared to first conductive strip 210. Instead of a deflection being concentrated in an immediate area of each tire passing over rubber jacket 405, as described above for first conductive strip 210, first conductive strip 410 is deflected over a larger portion of its length. Thus, per the formula described above, the area of the electroplate size may be assumed to be constant thus allowing any change in capacitance to be attributed to a different distance between first conductive strip 410 and second conductive strip 420. Such difference may then be converted to a weight based on predetermined criteria set for a variety of weights. Such criteria may be determined by experimentation or calculation utilizing the properties of the particular conductive strips to be utilized, as will be understood by those skilled in the art.

System 400 may be modified to utilize various insulators or a combination of different insulators. In one example a lower density foam rubber and higher density foam rubber insulator may be utilized between first conductive strip 410 and second conductive strip 420. Such an arrangement would allow a wide range of weight sensitivity. Specifically, the lower density foam rubber may allow a weight of lower weight vehicles (e.g., motorcycles) to be determined while the higher density foam rubber insulator may allow a determination of a weight for heavier vehicles. For example, a higher density foam rubber may compress under the weight of a large vehicle, e.g., a tractor trailer, to allow the first conductive strip 410 to deflect and a weight thereof to be determined, but it may not compress when a lower weight vehicle, e.g., a motorcycle, passes thereover. However, a lower density foam rubber between two conductive strips may be compressed by a lower weight vehicle, e.g., the motorcycle, which may allow the weight thereof to be determined. Thus, different magnitudes of changes in capacitance detected by capacitance detector 480 may allow a determination of weight of different classes of vehicles. Alternatively, different density insulators may be utilized in adjacent capacitive detectors to allow such determinations.

Figure 14:
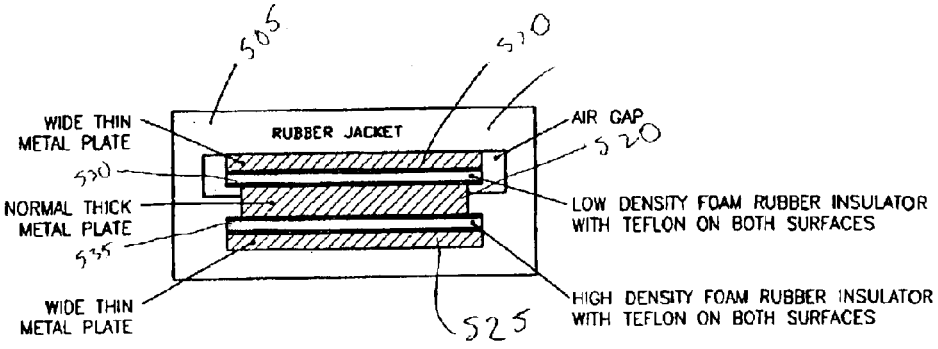
FIG. 14 is an end cross sectional view of a further embodiment of a system for use in classifying a vehicle having three conductive strips, in accordance with the present invention.

In another embodiment, a system 500 for detecting tire width and weight is depicted in FIG. 14. A capacitive sensor 502 includes a first conductive strip 510 located above a second conductive strip 520 which is located above a third conductive strip 525. These conductive strips are coupled to one or more capacitance detectors (not shown) and are located in a rubber jacket 530 of a treadle (not shown) configured to be located in a cavity (not shown) of a roadbed (not shown) or on a surface thereof. A first insulator 530, for example, a low density foam rubber insulator (e.g., super soft foam rubber), and possibly a space (not shown) may be located between first conductive strip 510 and second conductive strip 520. A top and a bottom face of first insulator 530 may include a wear resistant surface, e.g. TEFLON tape, which may provide additional insulation value. A second insulator 535, for example a high density foam rubber insulator (e.g., medium density silicone foam rubber), and/or a space (not shown) may be located between second conductive strip 520 and third conductive strip 525. Also, top and bottom faces of second insulator 535 may include a wear resistant surface, e.g. TEFLON tape. First conductive strip 510 and third conductive strip 525 may be more flexible and wider than second conductive strip 520. These differences may allow first conductive strip 510 and third conductive strip 525 to remain vertically aligned with second conductive strip 510 while a vehicle (not shown) passes over rubber jacket 505. Alternatively, second conductive strip 520 may be wider than first conductive strip 510 and third conductive strip 525 to allow at least a portion of these strips to remain vertically aligned during use.

A tire width of a vehicle (not shown) passing over system 500 may be determined based on the deflection of first conductive strip 510 to operatively abut second conductive strip 520 via first insulator 530 due to the weight of the vehicle and a first capacitance signal determined by a first capacitance detector (not shown) coupled to first conductive strip 510 and second conductive strip 520. Second conductive strip 520 may be deflected toward third conductive strip 525, while leaving a space between second conductive strip 520 and third conductive strip 525, due to the weight of the vehicle. Such weight may be determined based on a capacitance signal determined by a second capacitance detector (not shown) coupled to second conductive strip 520 and third conductive strip 525. Specifically, the weight of the vehicle on a particular portion of rubber jacket 505 causes a particular portion of first conductive strip 510 to operatively abut second conductive strip 520 and second conductive strip 520 to deflect toward third conductive strip 535, thus allowing such weight to be determined by a second capacitance detector. Alternatively, a single capacitance detector may perform the function of the first and second capacitance detectors described.

Figure 15:
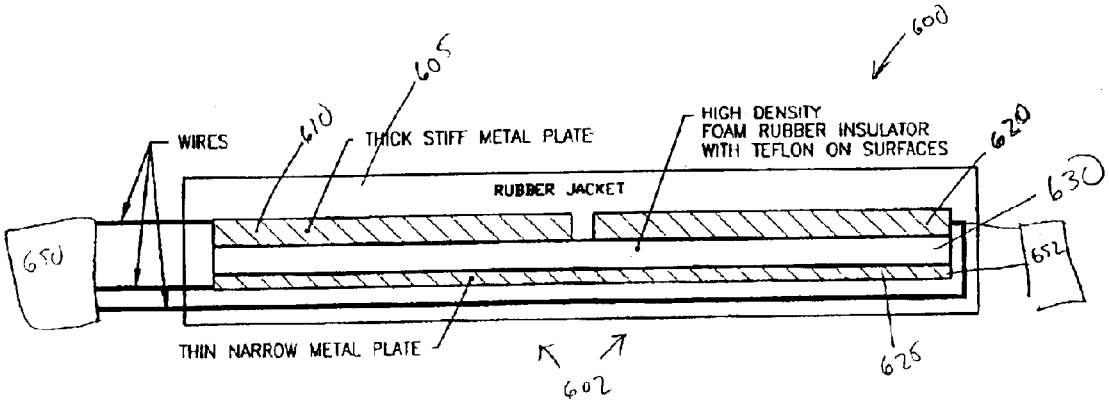
FIG. 15 is a front cross sectional view of a system for use in classifying a vehicle having a first conductive strip split into two portions and a second conductive strip below the first conductive strip, in accordance with the present invention.

In another example, a system 600 for classifying a vehicle is depicted in FIG. 15. A capacitive sensor 602 includes a first conductive strip 610 and a second conductive strip 620 aligned in a direction substantially orthogonal to a direction of vehicle traffic and located at a substantially same height above a third conductive strip 625 in a rubber jacket 605 of a treadle (not shown) in a cavity (not shown) of a roadbed (not shown). An insulator 630, e.g., a high-density foam rubber insulator, is located between first conductive strip 610 and third conductive strip 625 and between second conductive strip 620 and third conductive strip 625. A wear resistant wear resistant material 690, e.g., TEFLON tape, may be provided between insulator 630 and first conductive strip 610, second conductive strip 620 and/or third conductive strip 625. First conductive strip 610 and second conductive strip 620 may be substantially rigid while third conductive strip 625 may be more flexible, thinner and narrower than first conductive strip 610 and second conductive strip 620. First conductive strip 610 and third conductive strip 625 may be coupled to a capacitance detector 650 while second conductive strip 620 and third conductive strip 625 may be coupled to a second capacitance detector 652. As a vehicle passes over rubber jacket 605, a first wheel or set of wheels may pass over and deflect first conductive strip 610 toward third conductive strip 625 while a second wheel or set of wheels may pass over and deflect second conductive strip 620 toward third conductive strip 625 thus allowing capacitance detector 650 to determine a weight received by first conductive strip 610 and capacitance detector 602 to determine a weight received by second conductive strip 620. Further, it may be determined if the vehicle only crosses first conductive strip 610 or second conductive strip 620 due to a change in the capacitance signal(s) relative to each strip in combination with third conductive strip 625. For example, one wheel or a set of wheels may miss crossing a treadle completely if a roadway or toll lane is wider than the treadle itself.

The vehicle may be classified based on information received relative to first conductive strip 610 and/or second conductive strip 620. For example, a weight received by first conductive strip 610 may be doubled to determine a weight and thus an appropriate fare, if a vehicle only crosses over first conductive strip 610 instead of passing over both conductive strips. Also, it will be understood by those skilled in the art that first conductive strip 610 and second conductive strip 620 may be a single conductive strip separated into segments such as a first portion and a second portion. Further, first conductive strip 610 and second conductive strip 620 could be flexible while third conductive strip 625 could be rigid thus allowing a deflection of first conductive strip 610 and/or second conductive strip 620 toward third conductive strip 625 in an immediate area of a tire as the vehicle passes over rubber jacket 605. This latter arrangement may allow a determination of tire width as a vehicle passes over first conductive strip 610 and/or second conductive strip 620, as described above. Also, a determination of a weight of a first wheel by first capacitance detector 650 and a determination of a weight of a second wheel by a second capacitance detector 652 may allow a determination that one wheel of the vehicle is overweight relative to the other wheel.

Figure 1:
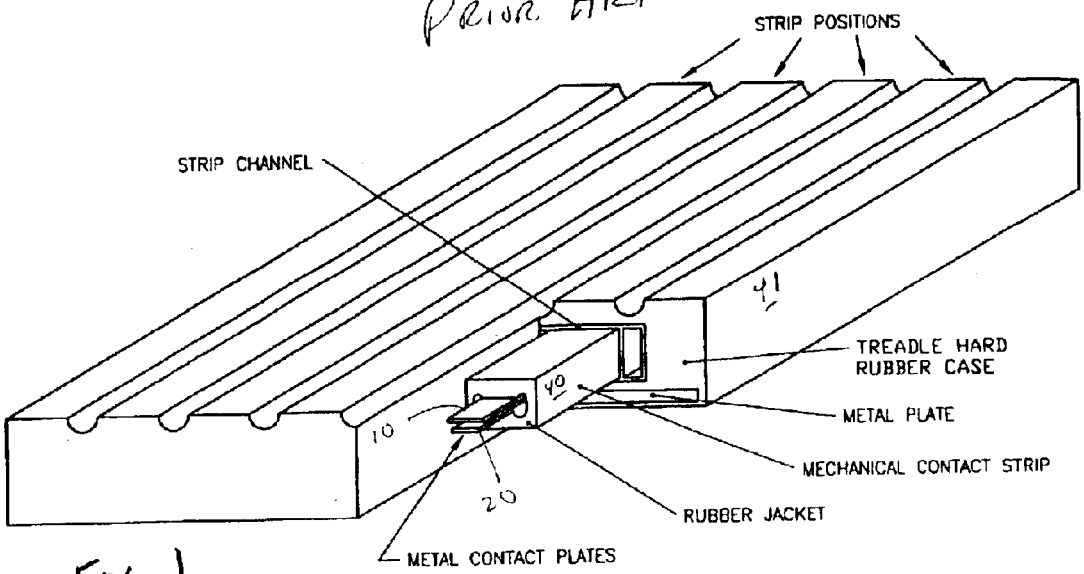
FIG. 1 is a perspective view of a prior art treadle having a mechanical contact switch encased in a rubber jacket.
Figure 2:
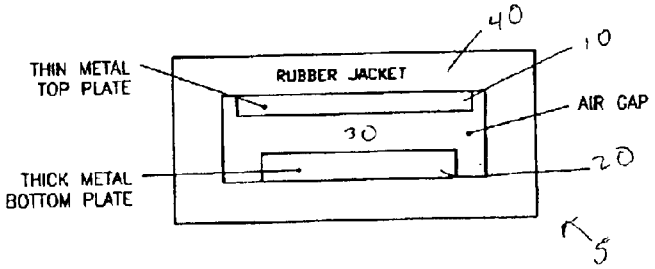
FIG. 2 PRIOR ART
FIG. 2 is an end cross sectional view of a portion of the treadle of FIG. 1.
Figure 3:
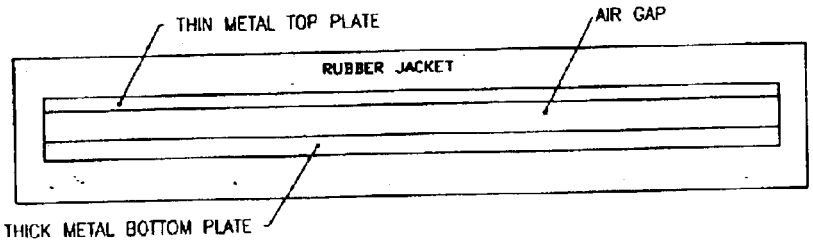
FIG. 3 PRIOR ART
FIG. 3 is a front cross sectional view of a portion of the treadle of FIG. 1.
Figure 16:
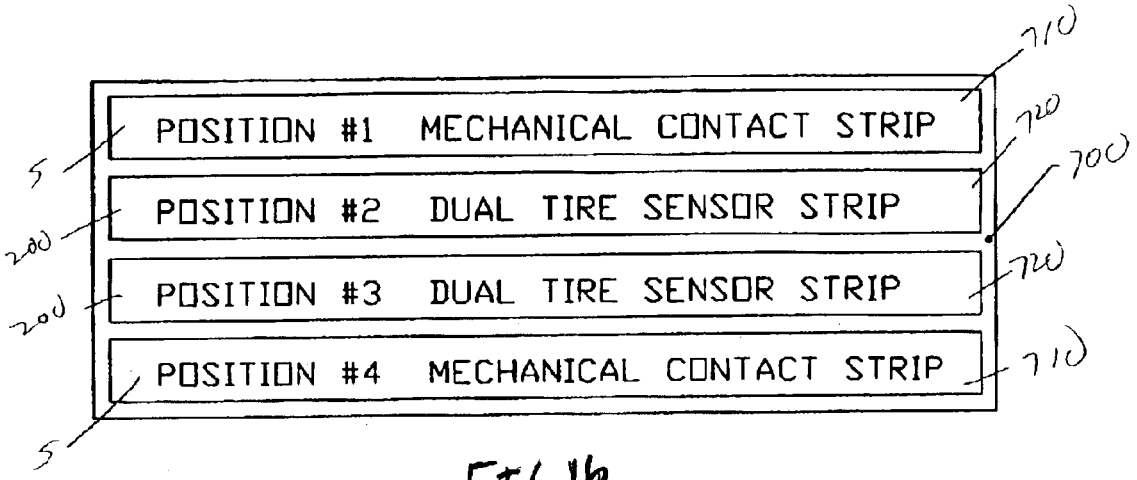
FIG. 16 is a block diagram of a top elevation view of a system for use in classifying a vehicle having multiple systems for classifying vehicles in accordance with the present invention.
Figure 17:
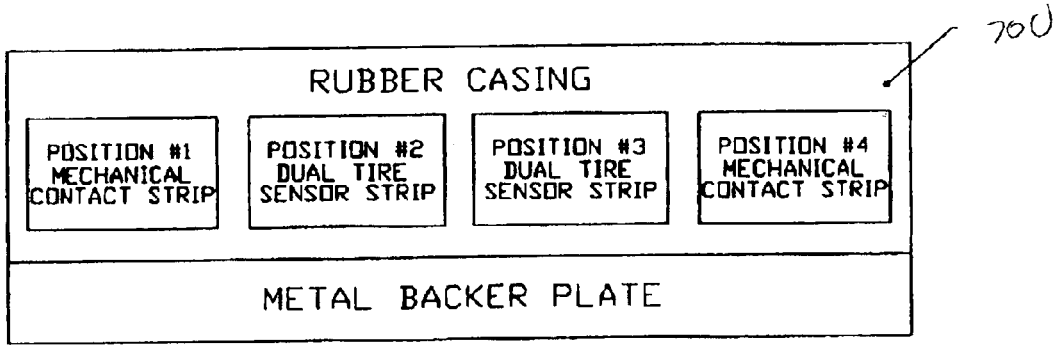
FIG. 17 is a block diagram of an end cross sectional view of the system of FIG. 15.

As illustrated in FIGS. 16–17, several systems for classifying a vehicle may be included in a treadle 700 which may be configured or dimensioned to be placed in a cavity (not shown) of a roadbed (not shown). For example, two contact switch systems 5 (FIG. 1) may be located in outer positions 710 of treadle 700. Two systems 200 (FIGS. 8–9) for classifying a vehicle according to tire width may be located in two inner positions 720. It will be understood by those skilled the art that various systems for classifying a vehicle may be arranged in different ways in such a treadle. For example, contact switch systems may be located in inner positions of a treadle while systems for classifying a vehicle according to tire width may be located in outer positions thereof. In another example, systems for classifying a vehicle according to weight may be located in inner or outer portions while the remaining portions may be systems for classifying a vehicle according to tire width or electrical contact systems. Also, it will be understood by those skilled in the art that treadles including systems for classifying a vehicle may be located in cavities of roadbeds or may be located on top of such roadbeds. Moreover, various other systems described above may be located in various positions in a treadle. For example, a system for detecting tire width, a system for detecting vehicle weight, or a capacitive sensor for detecting the presence of a vehicle may be located in various positions. Further, capacitive sensors may be located in various positions in such a treadle to determine vehicle speed and/or direction.

In particular, capacitive sensors (e.g., sensor 109, sensor 203, sensor 403) and associated capacitance detectors may determine a number of vehicles passing over a treadle or a length of time such vehicles are on the treadle. A speed of a vehicle might be determined using more than one capacitive sensor, e.g., in a single treadle, as depicted in FIG. 16. For example, a time may be determined between a change in capacitance for adjacent capacitive sensors to allow such a calculation of speed. Also, a weight of individual axles and a direction of vehicle travel may also be determined by using multiple capacitive sensors coupled to one or more capacitance detectors. For example, a time differential between weights being placed on adjacent sensors may allow a determination of such direction. Also, an analysis of the timing of capacitance changes in capacitive sensors may allow a determination of time spent on a treadle. For example, capacitance detectors coupled to capacitive sensors may be coupled to each other to allow a determination of speed, direction, and/or time on a treadle or a sensor. Alternatively, such individual capacitance detectors may be coupled to a separate capacitance detector or controller which may receive information as to a timing and/or magnitude of a change in capacitance of a particular capacitive sensor and may process such information to allow a determination of direction, speed, and/or time spent on a sensor and/or treadle.

It will be understood by those skilled in the art that the above described capacitance detectors (e.g.,) capacitance detector 150; See FIG. 5) may be a portion of a computing unit (e.g., a computing unit 151; See FIG. 5 adapted to determine such capacitance signals and to utilize the capacitance signals for classifying a vehicle. For example, a computing unit may compare a detected capacitance signal to a preset criteria to determine the classification of a vehicle passing over a system for classifying a vehicle included in a treadle. In one example, a capacitance signal might be compared to determine a width of tires passing over the treadle. Specifically, preset criteria may be input into the computing unit based on various widths of various tires such that the preset criteria may be compared later to an actual capacitance signal for determining an actual width of a tire passing over the treadle. Further, the computing unit might be coupled to a system (e.g., EZ PASS, FAST LANE) for charging fares to vehicles passing through tollbooths and over the treadles having systems for classification such that an appropriate fare might be charged to an account (e.g. a credit card) based on the tire width determined by a system for clarifying vehicles based on tire width. Similarly, fares might be charged based on vehicle weight.

The computing unit (not shown) may be a processor or computing unit, for example, a personal computer, such as a personal computer with Microsoft WINDOWS as the operating system and based on the Intel PC architecture, or an Apple Macintosh System. The computing unit may include, for example, one or more central processing units, memory, one or more storage devices and one or more input/output devices, as is well known in the art. For example, the computing unit may have a display (not shown) to enable visual output for viewing by a user.

The computing unit (not shown) may be coupled to the conductive strips of the capacitive sensor and/or a printer (not shown) via a standard connection (not shown), such as any type of wire connection, token ring or network connection, to name just a few examples. One example of a communications protocol used by one or more of these connections is TCP/IP which allows connection to a computer network, such as, for example, a local area network or a global computer network (e.g., the INTERNET). The computing unit may cause an indication of a capacitance signal, classification, weight, tire width, vehicle speed, vehicle direction, etc. to be printed on the printer or other means of providing such information.

The capacitance detector (e.g., computing unit) may further be coupled to a lane controller (not shown) which receives information from one or more capacitance detectors along with other information relative to a single lane of an automobile toll plaza (not shown). The lane controller may be a computing unit as described for the capacitance detector and may further be a mainframe or server, e.g., an IBM mainframe or server, a Hewlett Packard system running HP-UX, a UNIX derivative operating system, or other such system as will be known by those skilled in the art. The lane controller may be further be coupled to a plaza controller (not shown) which receives information from each lane controller in the automobile toll plaza and controls various aspects thereof. The plaza controller may be a computing unit as described for the lane controller. Such lane controller and/or plaza controller may also perform some or all of the functions described above for the capacitance detectors.

In one example, the capacitance detector may include a dual tire interface (not shown) coupled to two conductive strips of a capacitive sensor. The dual tire interface may be coupled to a dual tire processor (not shown). Also, the dual tire interface includes two 555 type timers with programmable resistors to adjust the frequency of operation of the capacitive sensor. When a capacitance of the capacitive sensor is changed by a vehicle passing thereover, the frequency output of the 555 timer is proportionally changed. Such frequency is then transmitted to the dual tire processor through a RS-485 level data stream, as will be understood by those skilled in the art. Each dual tire interface, and thus each capacitive sensor, has its own respective data stream.

The dual tire processor may interface with, and receive the data stream from, the dual tire interface to allow the dual tire processor to interpret such data stream output and to communicate such information to a lane controller to allow such information to then be transferred to a plaza controller, for example. The dual tire processor may be a micro-controller based processor board with a DSP co-processor. The data stream received from the dual tire interface may be received and converted to standard logic levels and passed through an optical (isolating) interface to the microprocessor, as will be understood by those skilled in the art. Each such data stream may then be measured on a per period basis to output a continuous measurement of a frequency thereof. The data may be filtered to remove noise spike and averaged to smooth out errors. Such averaging and filtering may be programmable, for example. Slope and peak levels of each data stream may then be measured and compared against pre-set levels to indicate a type of tires crossing over the capacitive sensor. The pre-set levels may be adaptable via software to adjust for changes in treadle and capacitive sensor performance, environmental changes, and aging of such a system. The data from each dual tire interface may be compared by the dual tire processor to verify performance and information relating to tire width, weight, vehicle speed, vehicle direction, which may be output via a RS-232 data stream to the lane controller. The dual tire processor may perform other functions such as adjusting a frequency of operation of the dual tire interface, measuring a base frequency continuously to self-calibrate a system, and to record historical data to adjust measurement levels. Further, a dual tire processor may be coupled to other sensors in a lane to detect other characteristics of a vehicle passing thereover. Such systems could include vehicle separation detectors, light curtains, profile detectors, vehicle sensing loops, and other such devices, as will be understood by those skilled in the art. The use of these other systems in combination with one or more capacitive sensors may allow more information to be provided to the dual tire processor, thus allowing a more accurate classification of a subject vehicle.

The conductive strips of the capacitive sensors described above could be any type of conductor with the upper conductive strips described above for tire width detection (e.g. first conductive strip 110, first conductive strip 210, first conductive strip 410, etc.) being adapted to deform or deflect to provide a change in capacitance from a static position in response to receiving a weight. The corresponding lower conductive strips (e.g. second conductive strip 120, second conductive strip 220, conductive strip 310, etc.) may be formed of any conductor, which is substantially rigid and allows a change in capacitance to be determined with the upper conductive strip based on a vehicle passing over a treadle. Also, the upper conductive strips used for weight detection (e.g. first conductive strip 410) may be made of any conductor, which is stiff or rigid such that it deflects over its entire length or a large portion thereof in response to a weight being placed thereon, instead of deflecting in an immediate area of the applied weight (e.g. a tire). Further, the upper and lower conductive strips may be of sufficient width relative to each other such that the movement of the upper conductive strip due to the vehicle passing thereover does not cause a disruption in capacitance signal due to a misalignment of one of the strips relative to the other. For example, the upper strip may be narrower than the lower strip or vice versa such that the movement thereof does not cause a disruption in the capacitance signal between the two strips.

Figure 18:
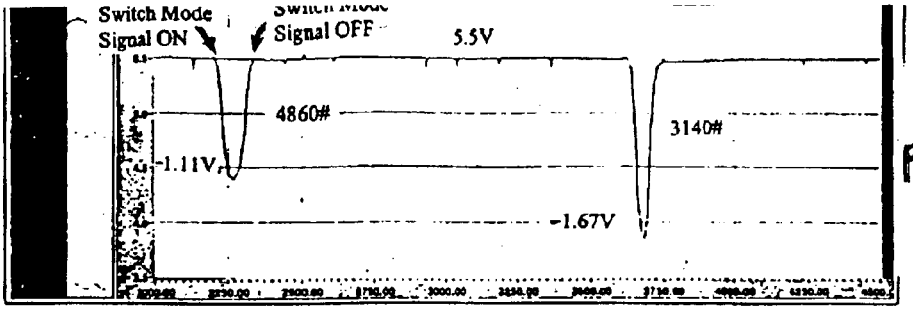
FIGS. 18 & 19 shows empirically derived examples of waveforms generated by the circuitry of the present invention which are used to determine tire width and vehicle weight.
Figure 19:
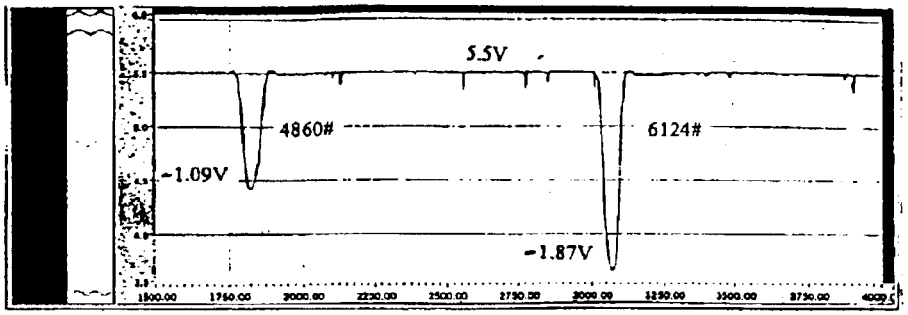
Figure 20:
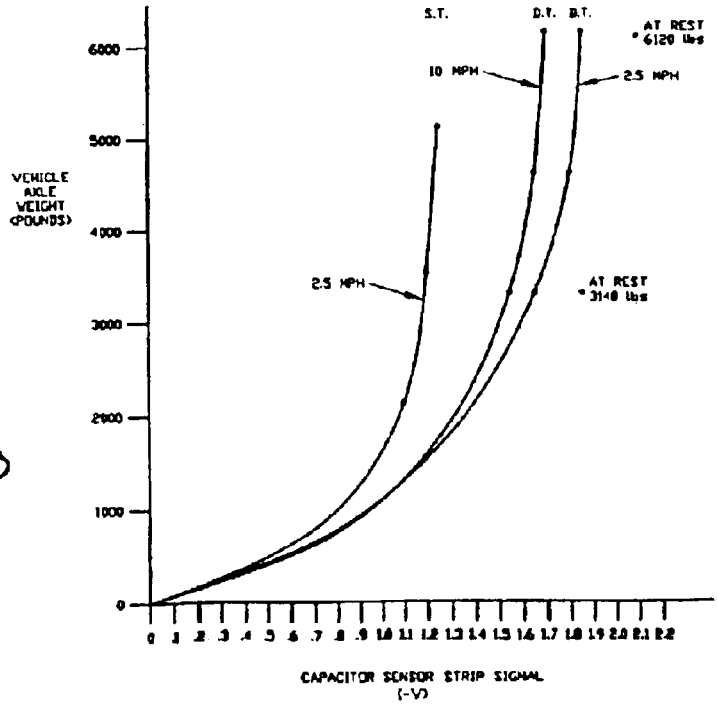
FIG. 20 shows a relationship of axle weight versus capacitance signal.

One example of the use of capacitance signals to determine tire width and vehicle weight is depicted in FIG. 18. Specifically, the waveforms depicted were obtained utilizing a detector circuit consisting of a 555-timer integrated circuit and an analog F-V (frequency to voltage converter) circuit to process the capacitance signal and a vehicle passing over such system. The signal on the left is a result of single tires of a front axle of a vehicle passing over a treadle having a system for classifying a vehicle by tire width (e.g., system 200). The signal on the left may be utilized as a switch to indicate the presence of a tire passing over a treadle to count vehicle axles. Alternatively, the signal on the left may indicate a single tire width having a spike of −1.11 volt due to the front axle of the vehicle while the signal on the right indicates a dual tire width having a spike of −1.67 volt of a rear axle of the vehicle. The −0.56 volt signal differential indicates the presence of a dual tire axle on the treadle. FIG. 19 depicts the use of the same circuits for the same vehicle as FIG. 18 but with such vehicle including additional weight thereon. Thus, FIG. 19 indicates that the weight of a vehicle may also be determined via the amount of change and comparison of a capacitance signal of a tire width detected. The signal on the left for a front axle has a spike of −1.09 volt, which is the same as the signal detected for the front axle in FIG. 18 corresponding to approximately 4,860 pounds, while the signal on the right has a spike of −1.87 volts which is larger than the −1.67 volt of the second axle in FIG. 18 and which corresponds to a weight of 6,124 pounds. Also, FIG. 20 depicts a relationship of axle weight versus capacitance signal.

The rubber jackets described above may be configured to be received in a treadle (e.g. treadle 41, treadle 700) as described above. Such jackets may alternatively be formed of other flexible materials such a urethane, rubber, or other elastomeric materials. Further, such jackets may be dimensioned or configured to be insertable and removable from the treadles described. Such treadles may include several systems for classifying vehicles and may be configured to be received in a cavity of a roadbed or they may be utilized on top of such a roadbed. The treadles may also be made of a material, which allows a weight (e.g. a vehicle) to be transferred therethrough to a rubber jacket which may allow such weight to be transferred to conductive strips held therein. Also, it will be evident to those skilled in the art that the systems for classification may be configured to include conductive strips of various flexibilities, widths, lengths, conductivity and/or stiffnesses to obtain desired information for classifying vehicles according to particular criteria. Further, it will be understood by those skilled in the art that the jackets may be formed to allow them to be utilized on a surface of a roadbed or otherwise without inserting them into the treadles described.

Further, the incorporation of the described systems for classification into rubber jackets configured to be received in treadles allows such systems in such treadles to be received in existing cavities of roadbeds. The configuration of such systems to be received in treadles reduces costs since the existing roadbed cavities may be utilized. Moreover, the described systems may be operated with or without other devices designed for vehicle classification, such as optical recognition devices. Also, the conductive strips in the cavity of the rubber jacket, as described, have high reliability, long life, and a wide temperature range of operation. Further, the use of a capacitance detector allows more information to be gathered than certain other devices. For example, electrical contact switches (e.g., system 5) only detect a number of axles passing thereover, and do not determine tire width or vehicle weight, unlike the systems and methods described above.

Also, it will be understood by those skilled in the art that the above described systems and methods may be utilized to classify various types of vehicles. For example, such vehicles may include standard passenger vehicles, commercial vehicles, tractor trailers, passenger vehicles towing trailers, motorcycles, and other vehicles normally utilized on local and interstate roads. Further, this system and method may be utilized in other environments, such as to classify vehicles in factory or manufacturing settings such as forklifts, forktrucks, robot vehicles, and other such vehicles as will be understood by those skilled in the art. For example, the weight of such vehicles may be determined via the above-described systems and methods. Thus, the capacitive sensor described above may be configured in various shapes and sizes to be utilized in such various settings.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A system for use in classifying a vehicle, said system comprising:

a capacitive sensor for operatively receiving a weight of a vehicle; and a capacitance detector coupled to said capacitive sensor, said capacitance detector adapted to determine a capacitance signal of said capacitive sensor in response to said capacitive sensor receiving the weight; and wherein said capacitance detector is adapted to determine a width of at least one tire of the vehicle passing over said capacitive sensor based on the capacitance signal.

2. The system of claim 1 wherein said capacitance detector is adapted to provide an indication of at least one of the capacitance signal and the width of the at least one tire.

3. The system of claim 1 wherein said capacitance detector is adapted to determine the weight of the vehicle based on the capacitance signal.

4. The system of claim 1 wherein said capacitive sensor comprises a first conductive strip configured to operatively receive the weight and a second conductive strip insulated from said first conductive strip.

5. The system of claim 4 wherein at least a portion of said first conductive strip is deflectable toward said second conductive strip in response to the weight.

6. The system of claim 5 wherein said first conductive strip is elastically returnable in response to the weight being removed from said first conductive strip.

7. The system of claim 4 further comprising an electrical insulator between said first conductive strip and said second conductive strip.

8. The system of claim 7 wherein said insulator is resilient to cause elastic returning of said first conductive strip in response to the weight being removed from the first conductive strip.

9. The system of claim 4 further comprising a third conductive strip located between said first conductive strip and said second conductive strip wherein said third conductive strip is coupled to said capacitance detector.

10. The system of claim 9 wherein said capacitance detector is adapted to determine a second capacitance signal between said first conductive strip and said third conductive strip to determine a width of at least one tire of the vehicle passing over said first conductive strip.

11. The system of claim 9 wherein said capacitance detector is adapted to determine a third capacitance signal between said second conductive strip and said third conductive strip to determine a weight of the vehicle.

12. The system of claim 4 wherein the weight comprises a weight applied by at least one tire and said first conductive strip comprises a material allowing a portion of said first conductive strip receiving the at least one tire to deflect toward said second conductive strip in response to said first conductive strip operatively receiving the weight.

13. The system of claim 4 wherein said first conductive strip comprises a material allowing said first conductive strip to deflect toward said second conductive strip in response to the weight and wherein said first conductive strip avoids operative contact with said second conductive strip while maintaining a space between said first conductive strip and said second conductive strip.

14. The system of claim 4 wherein said first conductive strip comprises a width in a direction substantially orthogonal to a longitudinal dimension of said first conductive strip and said second conductive strip comprises a second width in a direction substantially orthogonal to a second longitudinal dimension of said second conductive strip, and wherein said second width comprises a dimension less than said first width.

15. The system of claim 4 wherein said the first conductive strip comprises a first split conductive strip having a first part and a second part and wherein said capacitance signal comprises a first capacitance signal for said first part and said second conductive strip and further comprising a second capacitance detector adapted to determine a second capacitance signal for said second part and said second conductive strip.

16. The system of claim 15 wherein said capacitance detector is adapted to determine a width of a first tire of the vehicle based on said first capacitance signal and adapted to determine a second width of a second tire of the vehicle based on said second capacitance signal.

17. The system of claim 15 wherein said capacitance detector is adapted to determine a weight applied by a first tire of the vehicle based on said first capacitance signal and said capacitance detector is adapted to determine a second weight applied by a second tire based on said second capacitance signal.

18. The system of claim 4 wherein said first conductive strip comprises a material more flexible than a material forming said second conductive strip.

19. The system of claim 4 further comprising a jacket having a cavity, said second conductive strip being located in said cavity and wherein said jacket comprises said first conductive strip.

20. The system of claim 1 wherein said capacitance detector comprises a computing unit.

21. The system of claim 20 wherein said computing unit is adapted to determine at least one of a tire width of the vehicle and the weight based on the capacitance signal.

22. The system of claim 21 further comprising a second computing unit adapted to receive an indication from said first computing unit of the at least one of a tire width of the vehicle and the weight and said second computing unit being adapted to compare the indication to at least one classifying criteria to determine a classification of the vehicle.

23. The system of claim 22 wherein said second computing unit is adapted to determine an appropriate fare for the vehicle based on the classification.

24. The system of claim 1 wherein said capacitive sensor is configured to be located in a cavity of a treadle.

25. A method for use in classifying a vehicle, the method comprising:

receiving the vehicle on a surface of a capacitive sensor; and determining a capacitance signal in response to the vehicle being received on the surface of the capacitive sensor; and providing an indication of a width of at least one tire of the vehicle in response to the capacitance signal.

26. The method of claim 25 wherein the capacitive sensor comprises a first conductive strip and a second conductive strip.

27. The method of claim 25 further comprising locating the capacitive sensor in a cavity of a treadle.

28. The method of claim 25 further comprising determining a weight of the vehicle based on the capacitance signal.

29. The method of claim 25 wherein the determining is performed by a first computing unit.

30. The method of claim 25 further comprising comparing the capacitance signal to a second capacitance signal determined at least one of before the vehicle passes over the capacitive sensor and after the vehicle passes over the capacitive sensor to determine at least one of a tire width and a weight of the vehicle.

31. The method of claim 28 further comprising electronically providing an indication of the at least one of a tire width and a weight of the vehicle to a computing unit.

32. The method of claim 31 further comprising electronically comparing the at least one of a tire width and a weight by the computing unit to a predetermined criteria to classify the vehicle.

33. The method of claim 32 further comprising causing an electronic payment to be made based on the classification.

34. The method of claim 25 further comprising receiving the vehicle on a second surface on a second capacitive sensor and determining a second capacitance signal in response to the vehicle being received on the second surface of the second capacitive sensor.

35. The method of claim 34 further comprising electronically determining at least one of a vehicle direction and a vehicle speed based on the first capacitance signal and the second capacitance signal.

36. The method of claim 25 further comprising electronically determining a presence of the vehicle on the surface of the capacitive sensor based on the capacitance signal.

37. The method of claim 36 further comprising electronically providing an indication of the presence of the vehicle on the surface of the capacitive sensor based on the capacitance signal.

38. A system for a use in classifying a vehicle, said system comprising:

a treadle having a first cavity and a second cavity;

a first conductive strip insulated from a second conductive strip, said first conductive strip and said second conductive strip being located in said first cavity and being coupled to a capacitance detector;

a third conductive strip and a fourth conductive strip located in said second cavity.

39. The system of claim 38 wherein said capacitance detector is adapted to determine at least one of a weight of the vehicle and a tire width of the vehicle, in response to the vehicle passing over said first conductive strip.

40. The system of claim 38 wherein said third conductive strip and said fourth conductive strip are coupled to an electrical contact detector for determining a contact between said third conductive strip and said fourth conductive strip.

41. The system of claim 40 wherein said electrical contact detector is adapted to count a number of vehicles passing over said third conductive strip.

42. The system of claim 38 wherein said third conductive strip and said fourth conducting strip are coupled to a second capacitance detector, said second capacitance detector being adapted to determine a second capacitance signal between the third conductive strip and the fourth conductive strip.

43. The system of claim 42 wherein said second capacitance detector is adapted to determine at least one of a tire width of the vehicle and a weight of the vehicle.

44. The system of claim 38 wherein said third conductive strip and said fourth conductive strip are coupled to a second capacitance detector, said second capacitance detector being adapted to determine at least one of a tire width of the vehicle, a weight of the vehicle, and a presence of the vehicle, wherein said capacitance detector is adapted to determine at least one of a weight of the vehicle, a tire width of the vehicle, and a presence of the vehicle, and further comprising a computing unit for receiving information from the capacitance detector and the second capacitance detector regarding at least one of the tire width, the weight, and the presence of the vehicle.

45. The system of claim 44 wherein said computing unit is adapted to determine at least one of a speed of the vehicle and a direction of the vehicle based on the information.

46. The system of claim 44 wherein said computing unit is adapted to classify the vehicle based on the information.

47. The system of claim 44 further comprising at least one of a vehicle profile detector, a vehicle sensing loop, a vehicle separation detector and a light curtain coupled to said computing unit, wherein said computing unit is adapted to receive secondary classification information from the at least one of a vehicle profile detector, a vehicle sensing loop, a vehicle separation detector and a light curtain regarding a characteristic of the vehicle and wherein said computing unit is adapted to classify the vehicle based on at least one of the information and the secondary classification information.

48. A system for use in classifying a vehicle, said system comprising:

a jacket configured to be received in a treadle cavity of a treadle, said jacket comprising a strip cavity;

a first conductive portion configured to operatively receive a weight of the vehicle passing over said jacket;

a second conductive strip mounted in said strip cavity, said second conductive strip spaced from said first conductive portion; and said first conductive portion and said second conductive strip enclosed by said jacket and supported by said jacket such that said jacket substantially avoids extending into said strip cavity; and a capacitance detector coupled to said first conductive portion and said second conductive strip, said capacitance detector adapted to determine a capacitance signal of said first conductive portion and said second conductive strip in response to said capacitive sensor receiving the weight, and wherein said capacitance detector is configured to determine a weight of the vehicle based on the capacitance signal.

49. The system of claim 48 wherein said first conductive portion comprises a first conductive strip mounted in said strip cavity.

50. The system of claim 48 wherein said first conductive portion comprises a conductive portion of said jacket.

51. A method for use in classifying a vehicle, the method comprising:

providing a jacket configured to be received in a treadle cavity of a treadle, the jacket comprising a strip cavity;

mounting a second conductive strip in the strip cavity spaced from a first conductive portion configured to operatively receive a weight of the vehicle passing over the jacket;

enclosing the first conductive portion and the second conductive strip in the jacket and supporting the first conductive portion and the second conductive strip by the jacket;

coupling a capacitance detector to the first conductive portion and the second conductive strip;

operatively receiving the vehicle on the jacket; and determining a weight of the vehicle based on a capacitance signal determined by the capacitance detector.

* * * * *

UNITED STATES PATENT AND TRADEMARK OFFICE

CERTIFICATE OF CORRECTION

PATENT NO. : 6,894,233 B2
DATED : May 17, 2005
INVENTOR(S) : Dingwall et al.

It is certified that error appears in the above-identified patent and that said Letters Patent is hereby corrected as shown below:

Title page,
Item [75], Inventors, delete "Paul Milnick, Accord, NY (US); and insert -- Paul Melnick, Accord, NY (US); --

Signed and Sealed this

Twelfth Day of July, 2005

JON W. DUDAS
*Director of the United States Patent and Trademark Office*